US009688437B1

(12) United States Patent
Dimer

(10) Patent No.: US 9,688,437 B1
(45) Date of Patent: Jun. 27, 2017

(54) COVER FOR A STACKABLE TRANSPORT PALLET

(71) Applicant: montara Verpacken mit System GmbH, Grossschirma (DE)

(72) Inventor: Christoph Dimer, Teltow (DE)

(73) Assignee: MONTARA VERPACKEN MIT SYSTEM GMBH, Grossschirma (DE)

( * ) Notice: Subject to any disclaimer, the term of this patent is extended or adjusted under 35 U.S.C. 154(b) by 0 days.

(21) Appl. No.: 15/065,990

(22) Filed: Mar. 10, 2016

(30) Foreign Application Priority Data

Jan. 19, 2016 (DE) ..... 20 2016 100 228 U

(51) Int. Cl.
*B65D 19/38* (2006.01)
*B65D 19/02* (2006.01)
*B65D 85/68* (2006.01)

(52) U.S. Cl.
CPC ..... *B65D 19/385* (2013.01); *B65D 19/02* (2013.01); *B65D 85/68* (2013.01); *B65D 2519/0097* (2013.01); *B65D 2519/00208* (2013.01)

(58) Field of Classification Search
CPC ..... B65D 2519/00935; B65D 2519/00004; B65D 2519/0094; B65D 2519/0096; B65D 2519/00955; B65D 19/44; B65D 19/00; B65D 19/40
USPC ..... 108/51.11, 53.1, 53.3, 53.5, 54.1, 55.1, 108/56.3; 248/346.02, 346.01; 206/386, 206/600, 595, 598, 599
See application file for complete search history.

(56) References Cited

U.S. PATENT DOCUMENTS 1,587,573 A * 6/1926 Young ..... F26B 25/18 108/53.1
3,521,764 A * 7/1970 Loomis ..... B65D 21/0209 108/53.1
3,524,415 A * 8/1970 Heiman ..... B65D 19/004 108/53.3
3,926,321 A * 12/1975 Trebilcock ..... B65D 85/62 108/53.1
3,944,070 A * 3/1976 Cardwell ..... B65D 19/004 108/53.1

(Continued)

FOREIGN PATENT DOCUMENTS

DE 29907964 11/1999
DE 19833364 1/2002

(Continued)

*Primary Examiner* — Jose V Chen
(74) *Attorney, Agent, or Firm* — Brooks Kushman P.C.

(57) ABSTRACT

A cover for a stackable transport pallet, wherein a corner element is fastened at each of the corners of a main panel, the corner elements are injection moldings made of plastic, the corner elements include an L-shaped corner bearing element and a corner guide element molded. The corner bearing elements rest on the main panel, wherein the outer edges of the corner bearing elements terminate flush with the main panel, the corner guide elements can be recessed in a form-fitting manner in correspondingly shaped apertures in the main panel, wherein the upper side of the corner guide elements terminates flush with the upper side of the main panel, the thickness of the guide elements is greater than the thickness of the main panel by such an extent that those parts of the corner guide elements which project beneath the main panel butt against the inner sides of the transport pallet.

15 Claims, 5 Drawing Sheets

(56) References Cited

U.S. PATENT DOCUMENTS 3,995,749 A * 12/1976 Haskins ..... B65D 19/0014 108/53.1
4,042,107 A * 8/1977 Kendig ..... B65D 19/44 108/53.3
4,226,192 A * 10/1980 Myers ..... B65D 19/0018 108/53.1
4,413,737 A * 11/1983 Wind ..... B65D 19/0018 108/53.1
4,865,202 A * 9/1989 Day ..... B65D 19/0018 100/2
5,524,554 A * 6/1996 Wilson ..... B65D 19/004 108/53.1
5,722,328 A * 3/1998 Darby ..... B65D 19/06 108/53.1
5,829,595 A * 11/1998 Brown ..... B65D 19/0018 206/386
5,918,551 A * 7/1999 Liu ..... B65D 19/10 108/53.1
6,409,138 B1 * 6/2002 Baccini ..... H05K 3/0097 108/53.1
6,463,863 B1 * 10/2002 Ishikawa ..... B65D 19/385 108/53.1
6,530,476 B1 * 3/2003 Overholt ..... B65D 71/0096 108/55.3
6,626,634 B2 * 9/2003 Hwang ..... B60P 3/055 108/51.11
6,718,887 B1 * 4/2004 Cook, Sr. ..... B65D 19/38 108/53.1
6,928,933 B2 * 8/2005 Grau ..... B41F 23/0443 108/57.25
8,511,239 B2 * 8/2013 Lin ..... B65D 19/0038 108/53.1
8,596,207 B2 * 12/2013 Dubois ..... B65D 19/0002 108/53.1
8,708,304 B2 * 4/2014 Dysinger ..... A47B 91/005 108/51.11
8,851,287 B2 * 10/2014 Becklin ..... B65D 21/0224 108/12
9,102,437 B2 * 8/2015 Frankenberg ..... B62B 5/0093
2003/0209171 A1 * 11/2003 Milles ..... B65D 19/0018 108/53.1
2006/0272556 A1 * 12/2006 Apps ..... B65D 19/004 108/53.1
2014/0284247 A1 9/2014 Balazs et al.

FOREIGN PATENT DOCUMENTS

DE 102008015157 4/2009
DE 102008023565 11/2009
EP 2860125 4/2015

* cited by examiner

COVER FOR A STACKABLE TRANSPORT PALLET

CROSS-REFERENCE TO RELATED APPLICATIONS

This application claims priority to DE Application No. 202016100228.1, filed Jan. 19, 2016, the disclosure of which is incorporated in its entirety by reference herein.

TECHNICAL FIELD

The invention relates to a cover for a stackable transport pallet which can be used again and again. Such transport pallets with a cover are used as large load carriers in order for in particular articles to be transported, and also stored, in a protected manner. The articles are, for example, motor-vehicle parts, in particular individual visible plastic parts which are intended to be transported, such as interior door paneling, armrests, center consoles, sun shields, A-, B- and C-pillar paneling as well as steering wheels, headlights and rear lights.

BACKGROUND

A closed large load carrier with a lifter-accessible base comprises, for example, a main plastic pallet, a closed ring, made up of hollow-chamber or structured-core panels, and a pallet cover. The lateral walls are usually foldable and can therefore be reduced in volume. A multiplicity of inserts may be present in the interior of the container for the purpose of separating or fixing the articles packed within.

When articles are stored and transported using pallets, stacking is a space-saving solution. It is always necessary here for the admissible payloads and stacking heights to be taken into account. It is only stable articles with horizontal bearing surfaces which are capable of being stacked. Loads can be provided with protective covers in order to give the articles optimum protection, projecting covers resulting in a reduction in loading volume.

The size of the associated covers is in line with the usually standard pallet sizes: 800 mm×1200 mm for Euro pallets and 1000 mm×1200 mm for industrial pallets. It is customary to have smaller and larger pallet sizes designed as fractions (e.g. 600×800) or a multiple (e.g. 1200×1600) of the main modules in each case.

The known covers are often injection-molded or thermoformed covers made of plastics. In particular covers for Euro pallets or industrial pallets or even larger covers often have a weight of more than 20 kg. Many countries have regulations which stipulate that parts above 12 kg have to be moved by 2 people. Moreover, covers of different sizes require additional, and usually very expensive, shaping tools of different sizes.

DE 10 2008 023 565 A1 relates to a transporting apparatus for the protected transportation of an article, having a base part, having a horizontal use surface and having a cover part. The cover part is spaced apart from the use surface of the base part by spacers provided in the corners of the base part. The spacers, which are injection molded from plastic, delimit the use surface around the outside. Angled elements for positioning on the side-part segments are provided on the underside of the cover. The transporting apparatus described is not suitable as a stacking container.

The container presented in DE 20 2008 015 157 U1 has a base profile all the way round, side walls of the container being plugged, in a manner known per se, into said base profile and fastened there. The container is closed by a cover. The cover has a cover flange and a cover-terminating profile all the way round. The invention provides for special stacking corners in each corner of the cover. Each stacking corner is designed such that it engages over the corner radius of the cover and extends a little beyond that still, for example by approximately half the corner radius, so that, to some extent, it also extends along the side wall of the container. Whereas the containers for the most part, that is to say also including the cover, are formed preferably from light metal, in particular from an aluminum alloy, the stacking corners preferably consist of impact-resistant and tough, but dimensionally stable, plastic, for example of ABS. The heavy metallic cover is suitable only for relatively small containers.

Covers for transport containers having a pallet base and a foldable wall ring are also described, for example, in EP 2 860 125 A2 or US 2014/0,284,247 A1. The covers described project beyond the container, as a result of which additional space is lost.

A reusable container according to DE 29 907 964 U1 comprises a stackable pallet, a sleeve, which can be plugged in a removable manner thereon, and a cover, which can be placed in position on said sleeve and closes the container, wherein the pallet and cover are shape-adapted to one another, at least in certain regions, such that they fit together—possibly with the interposition of a collapsed sleeve.

Such reusable containers of this type have an important role to play in logistics. Their particular advantage is that, for the purpose of transporting articles, they can be assembled, by virtue of a pallet, sleeve and cover being put together, to form a fully functioning container, which can be collapsed when not in use, that is to say when being returned in the empty state.

DE 19 833 364 C2 describes a packaging unit having a base part and having a covering part. The covering part is a so-called twin-sheet cover. Two-shell production from plastic in a twin-sheet process gives the components a relatively low weight along with a simultaneously high level of stability. In a twin-sheet process, in a manner known per se, two plastic sheets are thermally deformed at the same time and, in the thermoplastic state, are connected integrally to one another, that is to say welded, at suitable locations to create the cavities. The disadvantage here is that different cover sizes each require tools which have to be prepared specifically for them. Cost-effective production is possible only if very large numbers are being produced.

It is an object of the invention to propose a cover for a stackable transport pallet which provides an alternative to the prior art and has, on the one hand, a high level of stability and, on the other hand, a low weight. It should be capable of being produced in different sizes using straightforward means and in a cost-effective manner, without additional shaping tools being required. The cover should be space-saving and easy to handle.

SUMMARY

The invention is based on the idea of proposing a cover which is intended for a stackable transport pallet and eliminates most of the disadvantages mentioned.

The cover for a stackable transport pallet comprises a main panel, at each of the corners of which a corner element is fastened. The corner elements are injection moldings made of plastic, in particular polypropylene (PP). They comprise an L-shaped corner bearing element and a corner guide element molded thereon.

The corner bearing elements rest on the main panel, wherein the outer edges of the corner bearing elements should terminate flush with the main panel, so that no problematic projections are formed.

The corner guide elements can be recessed in a form-fitting manner in correspondingly shaped apertures in the main panel, wherein the upper side of the corner guide elements should terminate flush with the upper side of the main panel, so that no problematic projections or protruding edges are formed.

The thickness of the corner guide elements is selected to be greater than the thickness of the main panel by such an extent that those parts of the corner guide elements which project beneath the main panel butt against the inner sides of the transport pallet and ensure horizontal positioning on the inner edges of the side parts of the transport pallet. The corner guide elements are spaced apart horizontally from the outer edges of the corner bearing elements to such an extent that, when the cover is placed in position, said outer edges terminate flush with the side walls of the transport pallet.

The main panel is preferably a plastic structured-core panel. It is also possible to use plastic hollow-chamber panels. Structured-core panels consist of polypropylene and are produced from three components, which are welded to one another. The factor which differentiates them from conventional hollow-chamber panels, and therefore makes them so versatile, is the well-thought-out combination of the two smooth covering layers with the central nub layer. Forming the nubs on two sides and with a low cylinder height ensures an extremely high compressive strength and uniform material distribution. Overall, this unique panel construction provides for solid welding to the central layer, stable covering layers and perfect planar positioning of the panel. The symmetrically arranged studded structure gives rise to the formation of cavities which have air flowing through them and thus render the structured-core panels particularly lightweight.

In addition to the corner elements, intermediate elements can be arranged on the longitudinal and/or end sides of the main panel. The number and position of said intermediate elements depends on the size of the cover and the necessary loading which it has to withstand.

The intermediate elements, once again, are injection moldings made of plastic. The intermediate elements comprise a rectilinear intermediate bearing element and an intermediate guide element molded thereon. In a manner analogous to the corner elements, the intermediate bearing elements rest on the main panel, wherein the outer edges of the intermediate bearing elements, once again, terminate flush with the main panel. Intermediate guide elements, once again, can be recessed in a form-fitting manner in correspondingly shaped apertures in the main panel, wherein the upper side of the intermediate guide elements terminates flush with the upper side of the main panel. The thickness of the intermediate guide elements is greater than the thickness of the main panel by such an extent that those parts of the intermediate guide elements which project beneath the main panel butt against the inner side of the transport pallet and horizontal positioning on the inner edges of the side parts of the transport pallet is ensured. The intermediate guide elements are spaced apart horizontally from the outer edge of the intermediate bearing elements to such an extent that, when the cover is placed in position, said outer edges terminate flush with the side walls of the transport pallet.

In a preferred embodiment, the corner bearing elements and the intermediate bearing elements are fastened on the main panel. A solid connection, for example by means of a rivet connection, is preferred here. However, it is also possible for fastening to take place in a releasable manner by means of screw connections.

The corner bearing elements and/or corner guide elements and/or the intermediate bearing elements and/or the intermediate guide elements, instead of being made of solid material, may be parts which are open on one side and have ribbing in the transverse direction and/or longitudinal direction. This means that, despite weight being reduced, components with a high level of stability are achieved.

The corner bearing elements and/or the intermediate bearing elements may have reinforcements, via which the corner bearing elements and/or the intermediate bearing elements can be riveted or screwed to the main panel. The reinforcements are preferably formed by thickenings in the ribbing.

In one embodiment, an edge protector may be formed on the underside of a corner bearing element, said edge protector extending as far as the lower edge of the main panel, which is hollowed out here.

It is possible to provide, in the corner bearing elements and/or in the intermediate bearing elements, cover-stacking apertures which correspond with the outlines of corner guide elements of further covers present. This ensures horizontal positioning when a plurality of covers is being stacked.

For easier handling of the covers, handles may be provided on or in the main panel. In order to make it possible for a cover to be held in a certain position, parked-position holders may be provided on or in the main panel. A preferred embodiment provides for the parked-position holders to be parts which, with the exception of one side, are cut out of the main panel along the other sides and can be pivoted out of the main panel around a remaining folding hinge.

In order that the cover does not have any sharp edges and meets health and safety requirements, the edges of the main panel are thermally rounded.

The properties which can be achieved by the materials used and the construction of the cover mean that the cover is extremely stable and can be subjected to compressive loading and impact. It has smooth surfaces and is resistant to rotting and moisture. It is also food-safe, physiologically harmless and has outstanding chemical resistance. The cover is easy to print on and is completely recyclable.

Depending on the size which is to be produced, it is possible to achieve use-specific blanks without any need for high-outlay shaping tools.

DETAILED DESCRIPTION

An exemplary embodiment is illustrated in FIGS. 1 to 5. For transporting motor-vehicle parts from a supplier to the manufacturer, for final installation purposes, use is made of stackable transport pallets, which are intended to provide for reliable transportation of the articles contained and to achieve optimum handling with low outlay.

Figure 1:
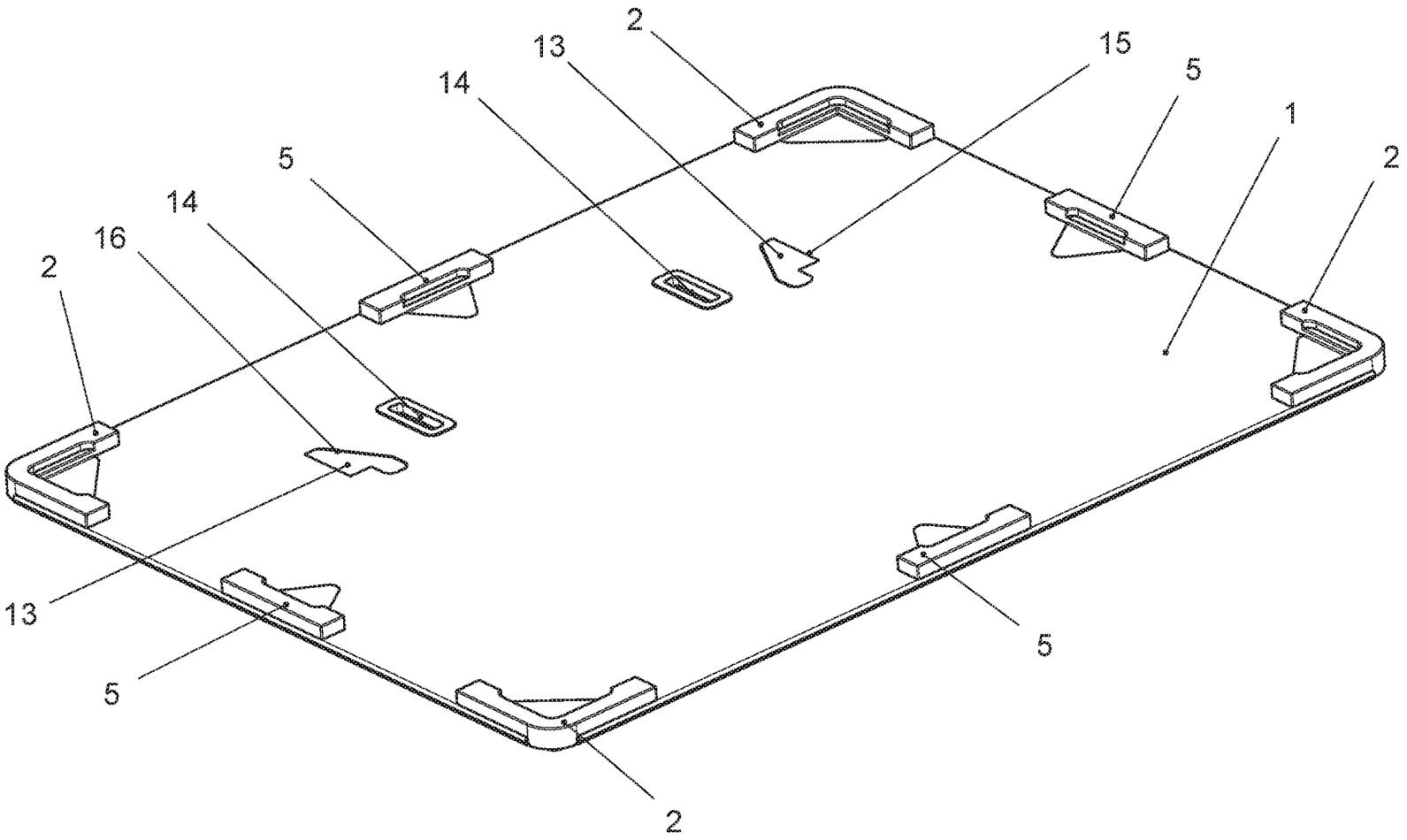
FIG. 1 shows a plan view of a cover.
Figure 2:
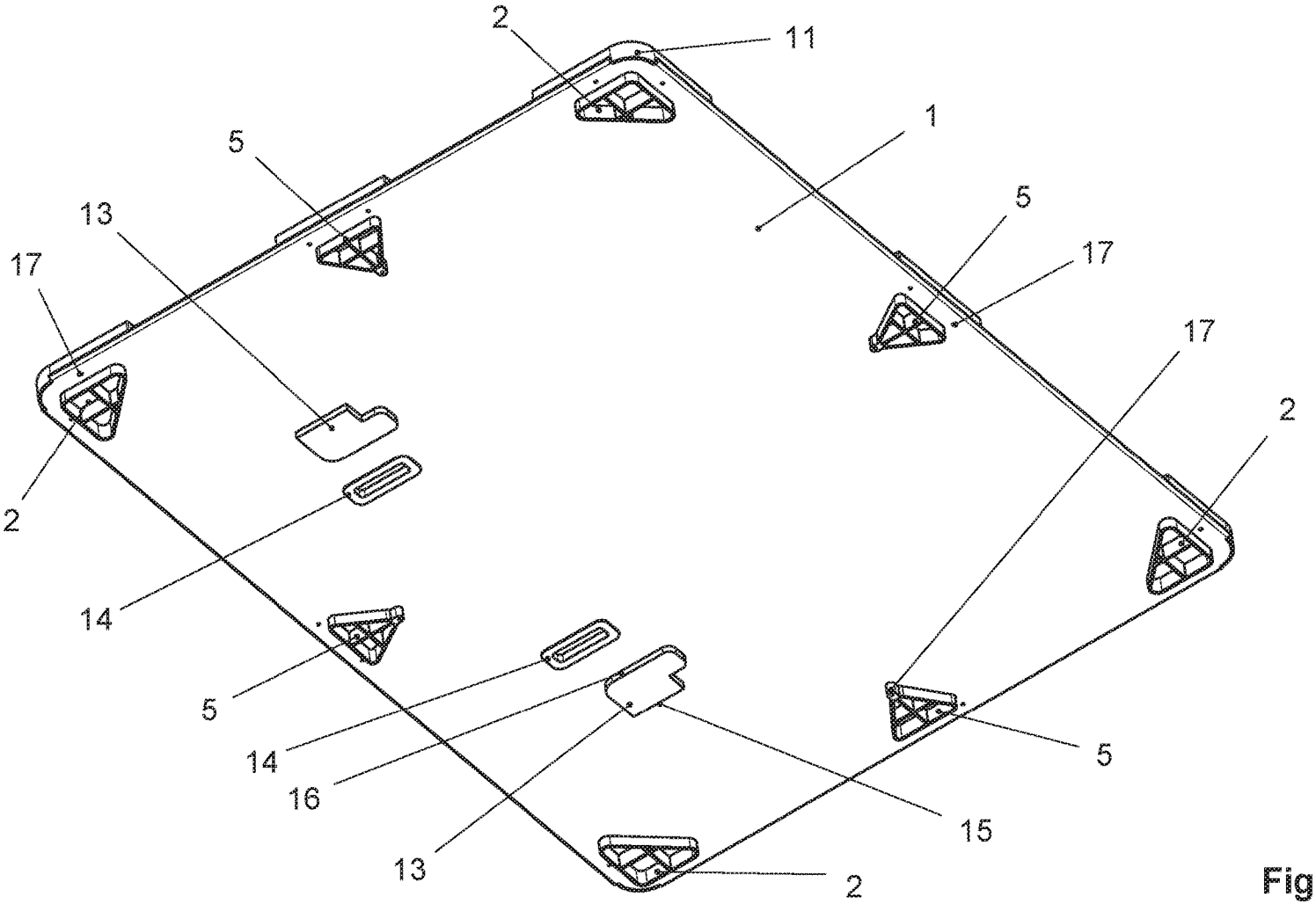
FIG. 2 shows a bottom view of the cover.

The illustration in FIG. 1 shows a plan view of the basic construction of a cover for a stackable transport pallet, and the illustration in FIG. 2 shows a bottom view of the same. For a Euro-pallet size, selected by way of example, of 1200 mm×1600 mm, the cover proposed has a main panel 1 having the same dimensions of 1200 mm×1600 mm. The main panel 1 is a PP-plastic structured-core panel which has a thickness of 10 mm and surfaces which are smooth on either side, internal nubs and slightly rounded corners.

Figure 3A:
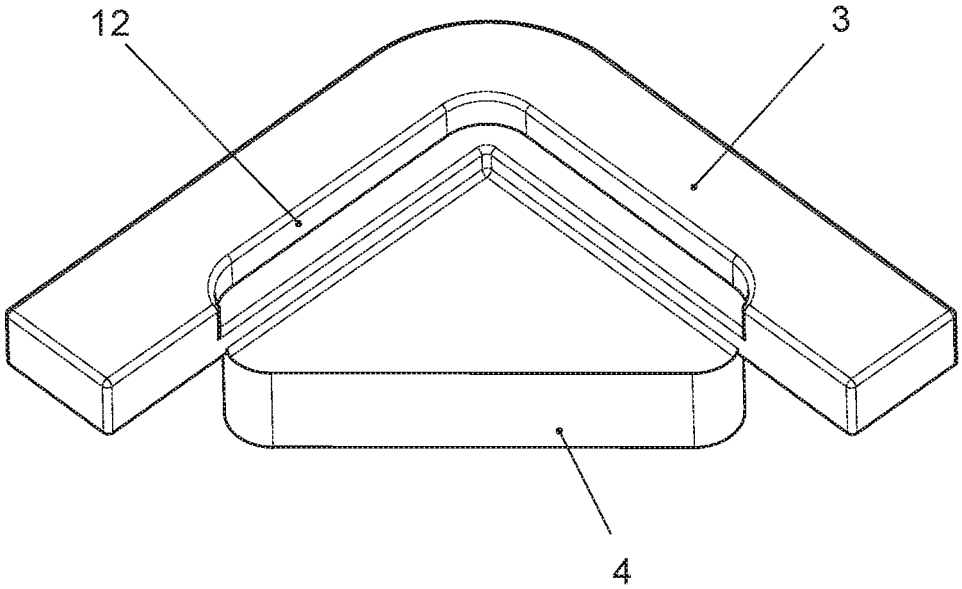
FIG. 3*a* shows a plan view of a corner element.
Figure 3B:
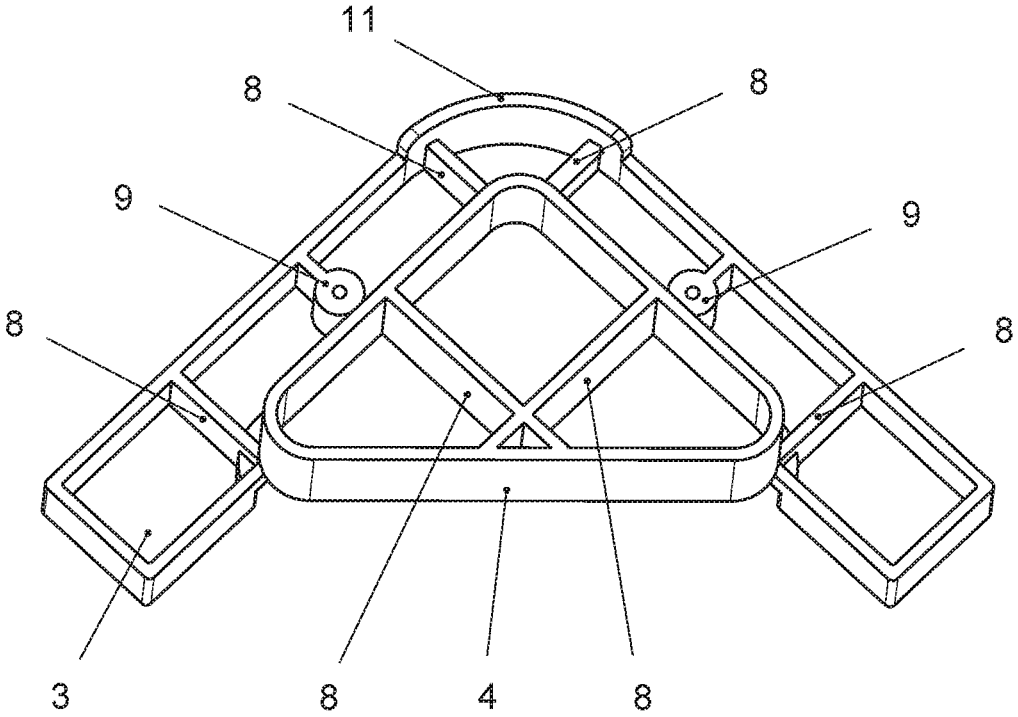
FIG. 3*b* shows a bottom view of the corner element.
Figure 4A:
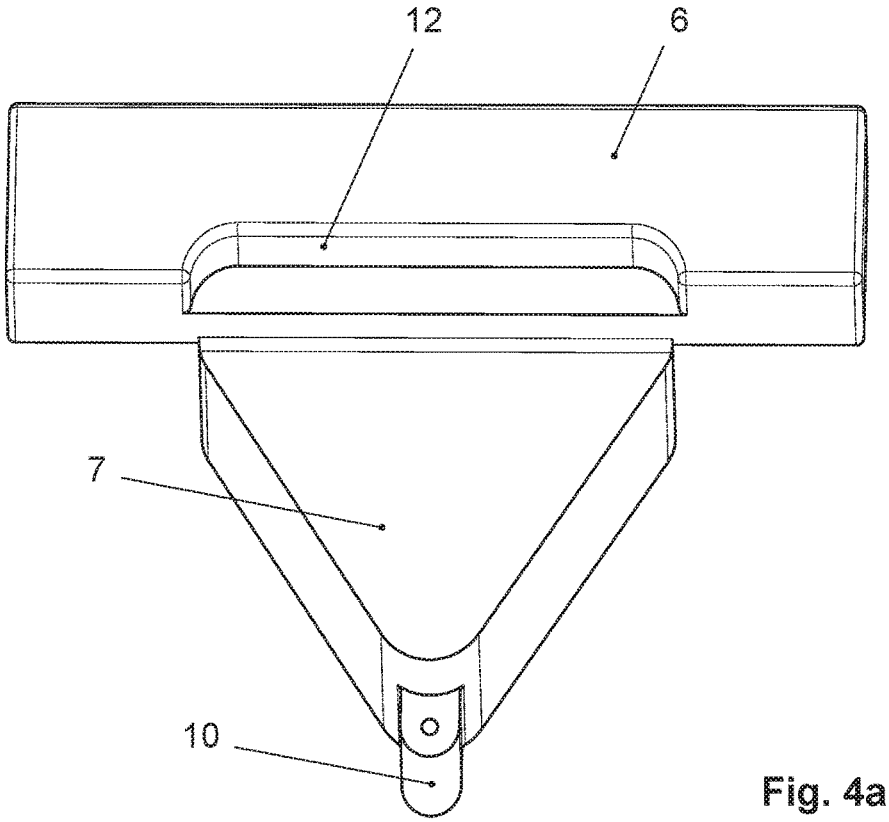
FIG. 4*a* shows a plan view of an intermediate element.
Figure 4B:
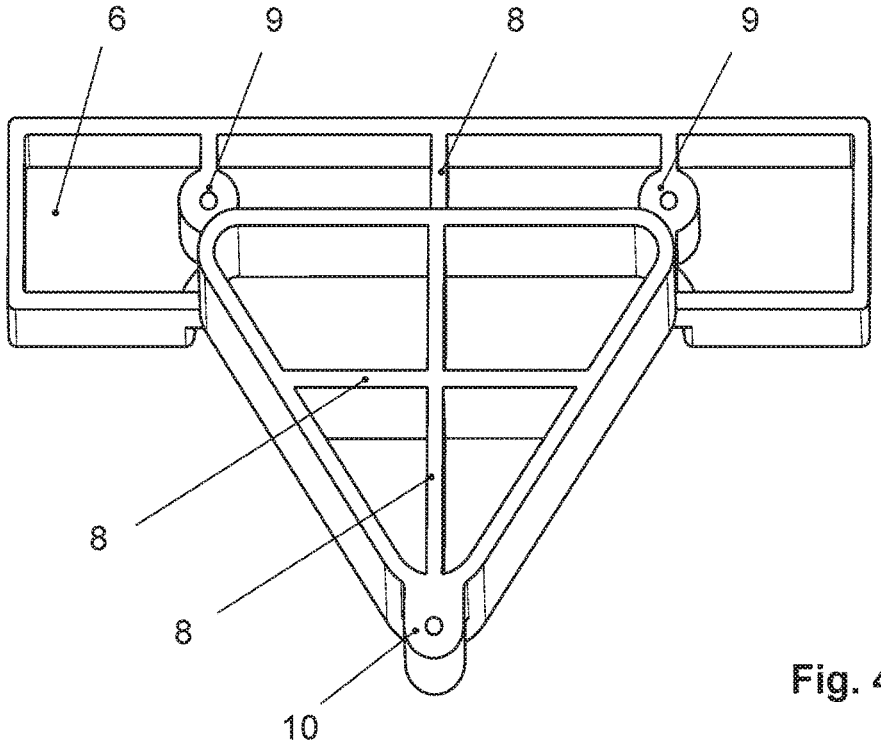
FIG. 4*b* shows a bottom view of the intermediate element.
Figure 5:
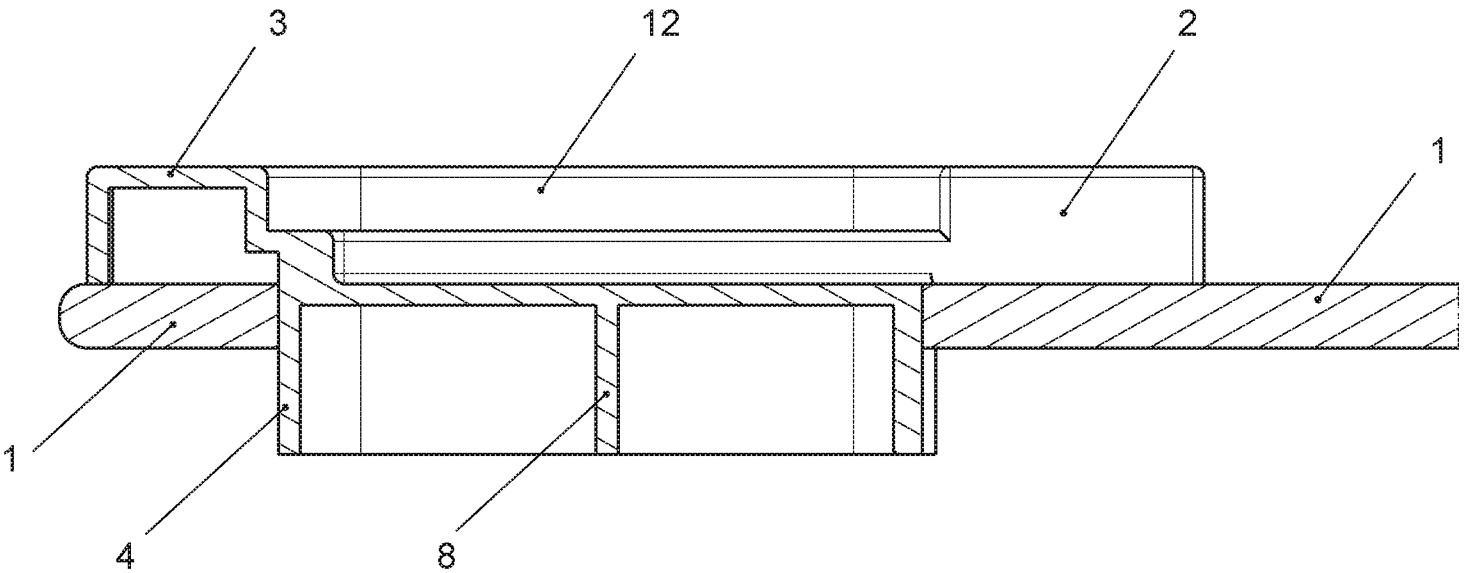
FIG. 5 shows a section through a corner element in the inserted state.

Corner elements 2 are fastened at each of the four corners of the main panel 1. In addition, intermediate elements 5 are fastened on each of the two longitudinal sides and end sides of the main panel 1. FIG. 3*a* gives an isometric illustration of a corner element 2 from above, and FIG. 3*b* gives an isometric illustration of the same from beneath. FIG. 4*a* shows an intermediate element 5 isometrically from above, and FIG. 4*b* shows the same isometrically from beneath. Both elements are plastic injection moldings made of polyethylene (PE). FIG. 5 shows a section through a corner element 2 which has been inserted into a main panel 1.

The corner elements 2 each have an L-shaped corner bearing element 3, which is rounded at the corners in a manner analogous to the pallet used, and a corner guide element 4, which is molded thereon, wherein the undersides of the corner bearing elements 3 are level with the upper sides of the corner guide elements 4.

The intermediate elements 5 each comprise a rectilinear intermediate bearing element 6 and an intermediate guide element 7 molded thereon. The corner bearing elements 3 and the intermediate bearing elements 6 rest on the main panel 1, wherein the outer edges of the corner bearing elements 3 and of the intermediate bearing elements 6 terminate more or less flush with the main panel 1, wherein a slight projection of a few mm can be ignored.

The corner guide elements 4 and the intermediate guide elements 7 can be recessed in a form-fitting manner in correspondingly shaped apertures in the main panel 1. The upper side of the corner guide elements 4 and of the intermediate guide elements 7 terminates flush with the upper side of the main panel 1. Protruding edges can thus be avoided.

The thickness of the corner guide elements 4 and of the intermediate guide elements 7, at 20 mm, is selected to be greater than the thickness of the main panel 1 by such an extent that those parts of the corner guide elements 4 or of the intermediate guide elements 7 which project beneath the main panel 1 butt against the inner sides of the transport pallet and ensure horizontal positioning on the inner edges of the side walls of the transport pallet.

The corner guide elements 4 and the intermediate guide elements 7 are spaced apart horizontally from the outer edges of the corner bearing elements 3 and of the intermediate bearing elements 6 by 33 mm such that, when the cover is placed in position, said outer edges terminate flush with the side walls of the transport pallet. In the case of this exemplary embodiment, the legs of the corner bearing elements 3 and of the intermediate bearing elements 6 have a length of 204 mm, a width of 45 mm and a thickness of 22 mm.

The corner bearing elements 3, the corner guide elements 4, the intermediate bearing elements 5 and the intermediate guide elements 7 are parts which are open in the downward direction on one side and have ribbing 8 in the transverse direction and/or longitudinal direction, said ribbing being formed during the injection-molding step. The corner bearing elements 3 have reinforcements 9, which are formed by thickenings in the ribbing 8. The corner bearing elements 3 are riveted to the main panel 1 by means of said reinforcements 9. The intermediate bearing elements 5 each have a molded formation 10 at the tip of the triangular intermediate guide elements 7. The molded formation 10 is set downward by a main-panel thickness of 10 mm and terminates flush, at the lower periphery, with the intermediate guide element 7 and the ribbing 8 contained therein.

The corner elements 2 and the intermediate elements 4 are fastened on the main panel 1 by the riveting 17. The horizontal arresting action is ensured in particular by the form-fitting integration of the corner guide elements 4 and of the intermediate guide elements 7 in the apertures in the main panel 1.

It can be seen in FIG. 3*b* that an edge protector 11 is formed on the underside of a corner bearing element 3, said edge protector extending as far as the lower edge of the main panel 1, which is hollowed out here.

Cover-stacking apertures 12 are provided in the corner bearing elements 3 and in the intermediate bearing elements 6. Said apertures correspond with the outlines of the corner guide elements 4 and serve for better stacking of the covers in relation to one another. Horizontal positioning of the covers which can be stacked one above the other thus takes place.

Two apertures into each of which a handle 14 has been inserted are located in the main panel 1. Parked-position holders 13 are also provided in the main panel 1. For this purpose, with the exception of one rectilinear side, appropriately shaped parts are cut out of the main panel 1 all the way along a cutting line 16. On the rectilinear side, the two parked-position holders 13 can be pivoted out of the main panel 1 around a folding hinge 15. The folding hinge is formed here in that the plastic structured-core panel has merely one of its two covering layers severed, and the parked-position holder 13 can be pivoted around the second covering layer.

The edges of the main panel 1 are heated, and rounded against a template, prior to assembly. This gives rise to a cover which is safe all the way round and largely fulfills the stringent health and safety requirements.

The cover proposed here has a weight of less than 12 kg. This means that it can also be handled by just one person, it being possible to reduce staff costs as a result. Depending on its use purpose, the cover can be adapted to different sizes. Apart from the customary tools used for cutting and/or for plotting or punching, there is no need for any additional tools. The absence of otherwise conventional angled or folded formations means that there is no need for in particular expensive shaping tools.

The covers have neither projections nor protrusions, as a result of which they terminate flush with the transport pallet and thus ensure good utilization of space.

As required, detailed embodiments of the present invention are disclosed herein; however, it is to be understood that the disclosed embodiments are merely exemplary of the invention that may be embodied in various and alternative forms. The figures are not necessarily to scale; some features may be exaggerated or minimized to show details of particular components. Therefore, specific structural and functional details disclosed herein are not to be interpreted as limiting, but merely as a representative basis for teaching one skilled in the art to variously employ the present invention.

While exemplary embodiments are described above, it is not intended that these embodiments describe all possible forms of the invention. Rather, the words used in the specification are words of description rather than limitation, and it is understood that various changes may be made without departing from the spirit and scope of the invention. Additionally, the features of various implementing embodiments may be combined to form further embodiments of the invention.

LIST OF DESIGNATIONS

1 main panel
2 corner element
3 corner bearing element
4 corner guide element
5 intermediate element
6 intermediate bearing element
7 intermediate guide element
8 ribbing
9 reinforcement
10 molded formation
11 edge protector
12 cover-stacking aperture
13 parked-position holder
14 handle
15 folding hinge
16 cutting line
17 riveting

What is claimed is:

1. A cover for a stackable transport pallet comprising:

a generally rectangular planar main panel having four corners; and four corner elements with a corner element fastened at each of the corners of a main panel, wherein:

the corner elements are injection moldings made of plastic, the corner elements each comprise an L-shaped corner bearing element and a corner guide element molded thereon, the corner bearing elements resting on the main panel, with outer edges of the corner bearing elements terminating flush with corners of the main panel, the corner guide elements extend through correspondingly shaped apertures located adjacent to and inboard of the corners in the main panel, wherein an upper side of the corner guide elements terminates flush with an upper side of the main panel, the corner guide elements having a thickness which is greater than the thickness of the main panel causing a portion of the corner guide elements to project beneath the main panel to butt against the inner sides of the transport pallet and ensure horizontal positioning on inner corner side edges of transport pallet, and the corner guide elements are spaced apart horizontally from the outer edges of the corner bearing elements to that, when the cover is placed in position on a transport pallet, said outer edges terminate substantially flush with outer side walls of the transport pallet.

2. The cover as claimed in claim 1, wherein the main panel is a plastic structured-core panel.

3. The cover as claimed in claim 2, further comprising a plurality of intermediate elements affixed to main panel adjacent to and inboard of longitudinal sides of the main panel.

4. The cover as claimed in claim 1, further comprising additional, intermediate elements arranged on the sides of the main panel.

5. The cover as claimed in claim 4, wherein;

the intermediate elements are injection moldings made of plastic, the intermediate elements comprise an intermediate bearing element and an intermediate guide element molded thereon, the intermediate bearing elements rest on the main panel, wherein the outer edges of the intermediate bearing elements terminate flush with the main panel, the intermediate guide elements extend through correspondingly shaped apertures located adjacent to and inboard of the side edges in the main panel, wherein an upper side of the intermediate guide elements terminates flush with an upper side of the main panel, the intermediate guide elements having a thickness which is greater than the thickness of the main panel causing a portion of the intermediate guide elements to project beneath the main panel to butt against an inner side of the transport pallet and ensure horizontal positioning on inner side edges of the transport pallet, and the intermediate guide elements are spaced apart horizontally from the outer edge of the intermediate bearing elements so that, when the cover is placed in position, said outer edges terminate substantially flush with outer side walls of the transport pallet.

6. The cover as claimed in claim 4, wherein the corner bearing elements and the intermediate bearing elements are fastened on the main panel.

7. The cover as claimed in claim 6, wherein the corner bearing elements or the intermediate bearing elements have reinforcements, which to allow the corner bearing elements or the intermediate bearing elements to be riveted or screwed to the main panel.

8. The cover as claimed in claim 7, wherein the reinforcements are formed by thickenings in a ribbing structure in the corner bearing elements or the intermediate bearing elements.

9. The cover as claimed in claim 1, wherein at least one of the corner bearing elements, the corner guide elements, the intermediate bearing elements and/or the intermediate guide elements are parts which are open on one side and have ribbing in a direction parallel to the main panel.

10. The cover as claimed in claim 1, wherein an edge protector is formed on an underside of the corner bearing element, with the edge protector extending as far as the lower edge of the main panel.

11. The cover as claimed in claim 1, wherein the region of the corner bearing elements projecting through the panel provide horizontal positioning of a plurality of covers when stacked on top of one another.

12. The cover as claimed in claim 1, further comprising handles are arranged on or in the main panel.

13. The cover as claimed in claim 1, further comprising a plurality of parked-position holders are arranged on or in the main panel.

14. The cover as claimed in claim 13, wherein the parked-position holders are cut out of the main panel and can be pivoted out of the main panel around a folding hinge.

15. The cover as claimed in claim 1, wherein the main panel has a plastic top and bottom layers and a plastic structured-core there between, wherein the side edges of the main panel are thermally rounded to seal the top and bottom layers together.

* * * * *